US005692308A

United States Patent [19]

Di Libero

[11] Patent Number: 5,692,308

[45] Date of Patent: Dec. 2, 1997

[54] CHEF'S KNIFE

[76] Inventor: Nicola R. Di Libero, 71 Lubec St., E. Boston, Mass. 02128

[21] Appl. No.: 689,908

[22] Filed: Aug. 15, 1996

[51] Int. Cl.[6] ..... B26B 9/02

[52] U.S. Cl. ..... 30/353; 30/355; 30/357; 30/308

[58] Field of Search ..... 30/113.1, 353, 30/355, 356, 308, 357; D7/650, 652; D22/118

[56] References Cited

U.S. PATENT DOCUMENTS

| | | | |
|---|---|---|---|
| D. 28,186 | 1/1898 | Barden . | |
| D. 177,743 | 5/1956 | Marx | D7/650 |
| D. 269,244 | 6/1983 | Becher et al. | D7/151 |
| D. 275,065 | 8/1984 | Steiner | D7/650 |
| 891,871 | 6/1908 | Smith . | |
| 1,051,454 | 1/1913 | Rouse, Jr. . | |
| 2,293,286 | 8/1942 | Fenner | 30/144 |

FOREIGN PATENT DOCUMENTS

| | | | |
|---|---|---|---|
| 532192 | 10/1954 | Belgium | 30/355 |
| 1238460 | 7/1960 | France | 30/357 |
| 476355 | 5/1929 | Germany | 30/355 |
| 803826 | 4/1951 | Germany | 30/355 |
| 26155 | of 1906 | United Kingdom | 30/353 |
| 536200 | 5/1941 | United Kingdom | 30/357 |
| 909277 | 10/1962 | United Kingdom | 30/357 |

*Primary Examiner*—Douglas D. Watts

[57] ABSTRACT

A knife comprising a blade and a handle adapted to be grasped with a hand. The blade comprises a body having a proximal and a distal end. A longitudinally-extending tang is disposed at the proximal end of the body to attach the handle to the body of the blade. The blade has a sharp cutting edge on a first margin and a flat edge on a second margin. The second margin is on the opposite side of the body. The first and second margins merge together at their distal ends to form a tip. The tip has a sharp cutting edge on each margin. The first margin has a serrated portion between the cutting edge on the tip and the cutting edge between the proximal end and the sharp cutting edge on the tip. The first margin is bowed outwardly between the proximal end and the distal end. The second margin extending longitudinally from the proximal end for a predetermined length and then bends obliquely for a second predetermined length to terminate in the tip.

7 Claims, 1 Drawing Sheet

CHEF'S KNIFE

BACKGROUND OF THE INVENTION

The present invention relates to new and improved cutlery and especially to a knife having positionally-arranged sections to perform a variety of cutting functions.

DESCRIPTION OF THE PRIOR ART

Knives used for cutting are well known to the art. Such knives generally have a single cutting surface which is finely honed to perform a cutting function. Commonly, such knives have a convex cutting surface which enables the user to conveniently extend the cut and efficiently provide thin slices of the object being worked upon.

When cutting objects which have skins which are resistant to finely-honed blades, cutting is made significantly more difficult. Starting an initial cut is difficult with objects such as tomatoes, for example, and many knife users slice such objects with serrated-edge knives. Serrated-edged knives, however, do not provide for thin slices and frequently produce jagged edges on the tomato. Moreover, in many cases, such as cooking meat with skins or crusty outer sides, initially starting the cut is difficult. I have found, however, that the initial cut can be easily made if the knife tip is honed on both sides so that the knife can puncture the object being sliced. When such puncturing is followed by a saw-like action from a serrated-edge cut and then completed with a sharp cut from a finely-honed blade, neat, thin slices can be provided which are substantially superior to slices made from only serrated-edge knives or only finely-honed blades. Moreover, I have found that such a knife can also be used as a serving mechanism if the blade is wide relative to its length. Objects such as pizza are routinely cut with a wheel which frequently does not cut all the way through the crust, especially if the wheel encounters a more solid topping such as sausage. With a knife having a sharp, pointed tip and the serrated edge disposed behind the tip, the initial cut can be easily made and the pizza can be sliced without dragging toppings through the cheese and disturbing the aesthetics of the pizza. When a convex knife blade is used after the initial puncturing of the crust, the curvilinear portion of the knife can be rotated in a direction normal to the plane of the pizza thereby cutting a slice neatly. Such cutting is highly advantageous over conventional knife wheels which collect molten cheese and are prone to becoming clogged and gummy thereby making them difficult to use and to clean.

In addition, knives usually are not used as serving tools. Such serving tools usually are separate instruments that have to be employed. Because knives usually are slender relative to their length they cannot easily be placed beneath a fairly wide object to be served without having the object fall or break. Such placement is frequently desirable with the serving of pizza.

Knives are frequently restricted in their sizes because of the necessity to obtain balance between the blade and the handle. Such balance is obtained by reducing the weight of the blade by making it narrower to accommodate a handle that has approximately the same weight (when taken in conjunction with a tang that is attached to the blade itself). Since the handle frequently is heavy relative to the blade, the blade is reduced in weight frequently by making it narrower or thinner.

SUMMARY OF THE INVENTION

According to the present invention I have discovered a knife which includes a blade and a handle. The handle is of conventional design and is adapted to be grasped by the hand. The blade includes a body that has a proximal and a distal end. A longitudinally-extending tang is disposed at the proximal end of the body and serves to attach the handle to the body of the blade. The blade has a sharp cutting edge on one margin and a flat edge on a second margin. The second margin is on the opposite side of the body and the first and second margins merge together at the distal end to form a tip. The tip has a sharp cutting edge on each margin. A serrated portion is disposed on the first margin between the cutting edge on the tip and the cutting edge between the proximal end and the sharp cutting edge on the tip. The first margin is convexly arranged between the proximal and distal ends. The second margin extends longitudinally from the proximal end for a predetermined length and then bends obliquely for a second predetermined length to terminate in the sharp tip. In the preferred embodiment the oblique angle of the second margin is between about 130 and 140 degrees. The length of the first margin is between about two to three times the length of the proximal end and the oblique angle forms a first and second segment on the second margin. The first segment has a length between about 25 and 30% of the second margin. The sharp tip constitutes between about 10 and 15% of the length of the second margin. The sharpened cutting edge constitutes between about 65 and 70% of the overall length of the first margin. The serrated edge constitutes between about 20 and 25% of the overall length of the first margin. The sharpened tip constitutes about 5 and 10% of the length of the first margin.

While all knives are used for cutting, through the unique construction herein disclosed, not only can the knife be used for boning meat, poultry and fileting fish, but also is useful for cutting tougher vegetables such as broccoli and cauliflower. With the double-edged tip followed by serrations on the first margin, fruits and vegetables, such as melons and even tough-skinned squash, can be cut with the double-tip making an easy entry followed by easy slicing.

The knife of the present invention is relatively simple in construction and in use, but has versatile uses for cutting or carving a wide variety of foods. The knife can easily be used to slice hot meats on its sharply-honed cutting surface while still being useful for cutting skinned fruits, such as tomatoes, and to pierce the foods so that an initial cut can be provided. Simultaneously with cutting, the broad body of the knife can be used as a serving instrument simply by placing the sharpened tip beneath the sliced object. Moreover, one margin of the knife is linear and can easily be used to scrape away trimmings after a cutting operation. The versatility of the knife of the present invention enables a user to utilize the knife in many operations heretofore requiring several knives and/or serving tools and/or scraping tools.

The many other objects, features and advantages of the present invention will become manifest to those skilled in the art upon reading the following specification, when taken in conjunction with the following claims.

DESCRIPTION OF THE PREFERRED EMBODIMENT

Figure 1:
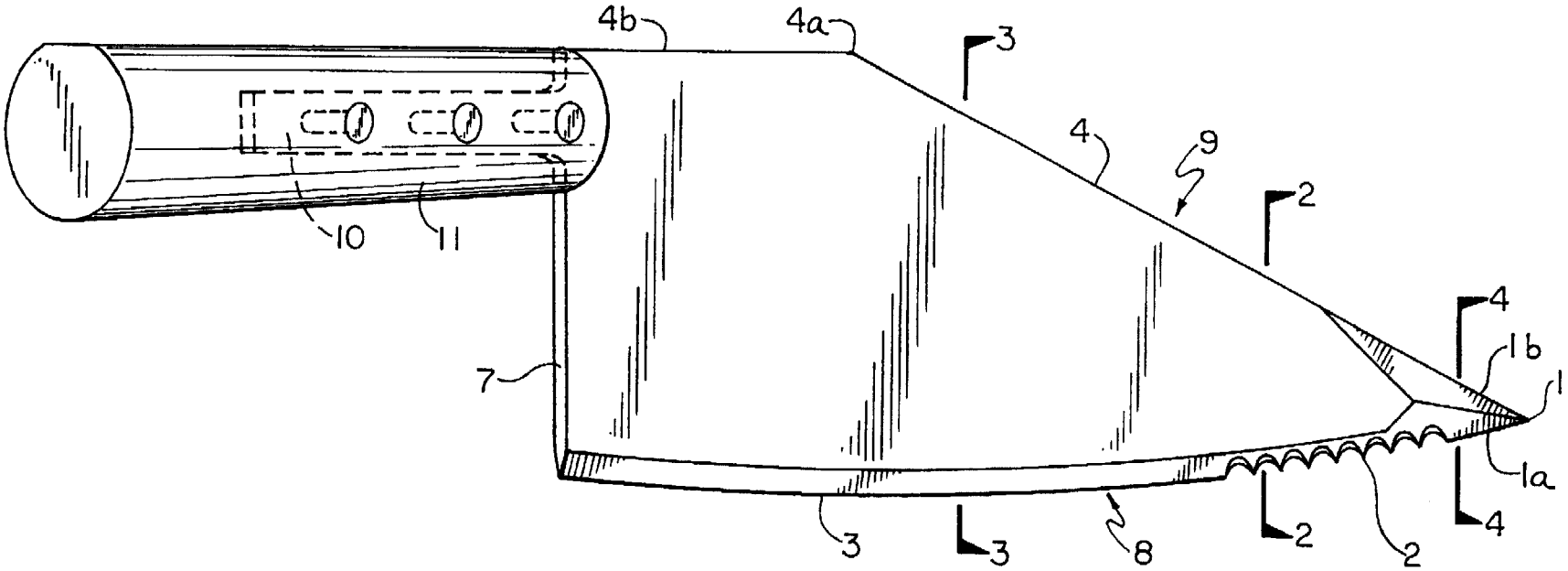
FIG. 1 is a side elevational view of an embodiment of a knife according to my invention.

As best illustrated in FIG. 1, the knife of the present invention extends from a tip 1 at its distal end to a base 7 as its proximal end. The blade has a sharp cutting edge 3 on a first margin 8 and a flat edge 4 on a second margin 9. The first margin 8 and the second margin 9 merge together to form the tip 1. The first margin 1 comprises three sections. A tip 1*a* having a honed edge is disposed at the distal end of the knife and constitutes the first section. A convex sharpened edge 3 is also disposed on the first margin and constitutes the third section.

A serrated section 2, constituting the second section, is disposed between the tip section la and the blade 3. The serrated section can be formed by hollow grinding each side of the first margin 8 and the edge to provide a wavy formation with a number of convexly-curved portions which meet one another to form Vs or cusps which may be slightly curved at the apices. The wavy edge may also be formed by grinding so that the depressions are concavely curved and the crests are convexly curved. Any conventional means for forming the serrations to a desired depth may be used according to the present invention so long as the serrations are disposed between a sharpened tip and a linearly-extending, sharpened cutting edge 3. The sharpened cutting edge 3 constitutes between about 65 and 70% of the overall length of the first margin 8. The serrated edge 2 constitutes between about 20 and 25% of the overall length of the first margin 8. The sharpened tip constitutes about 5 and 10% of the length of the first margin 8.

It has been found that these general proportions give the most effective cutting edges for carvers of a wide variety of cuttable objects, enabling the cutter to pierce the skin with the tip 1 and then commence cutting the skin with the serrated portion 2 concluding with a long cut with the sharp, honed edge 3.

The initial puncturing of the object to be cut is provided with the tip 1. Tip 1 has a sharp, honed edge on each of the first and second margins 8 and 9, where they merge together. Sharp edge la is on the first margin and sharp edge 1*b* is on the second margin. Sharp edge 1*b* gradually tapers into a flat edge 4 forming a portion of the second margin 9. The flat edge 4 can serve several functions including providing a wide receiving base for sliced material being cut. But, quite importantly, flat edge 4 can also serve as a scraping mechanism to scrape particles from a cutting board into a refuse bucket.

The second margin 9 is divided into two segments. The first segment, as discussed above, extends longitudinally a predetermined length in a straight line from the tip 1. The second segment is at an oblique angle relative to the first segment between about 130 and 140 degrees and extends to the proximal end 7 of the knife. The oblique angle provides for a wider base on the knife blade at the proximal end, thereby enabling the user to cut objects more easily and to provide for the ready serving on the enlarged flat surface.

A tang 10 is disposed at the proximal end 7 of the blade and extends within a handle 11 and is conventionally attached thereto with rivets or bolts to provide for holding the knife.

Figure 4:
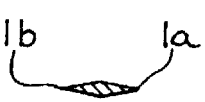
FIG. 4 is a cross-section taken along the line 4—4 of FIG. 1 and showing a cutting edge on both margins of the tip of the knife.
Figure 3:
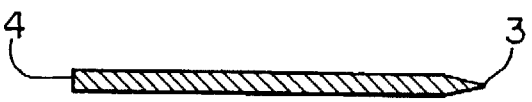
FIG. 3 is a cross-sectional view taken along the line 3—3 of FIG. 1 at a point where the sharply-honed cutting edge is disposed on one margin and the scraping tool is disposed on the opposite margin.
Figure 2:
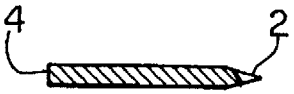
FIG. 2 is a cross-sectional view taken along the line 2—2 of FIG. 1 showing a cross-section of the knife taken at a point of the serrations on the cutting edge.

As shown in FIG. 3, the blade 3 is disposed at one side and the flat edge 4 is disposed at the other side of the blade. As shown in FIG. 2, the flat side 4 is disposed at one side of the blade and the serrations 2 are disposed at the other. In FIG. 4, both sides of the blade, 1*b* and 1*a*, are both sharp and form the tip.

While it is apparent that changes and modifications can be made within the spirit and scope of the present invention, it is my intention, however, only to be limited by the scope of the following claims. As my invention I claim:

What is claimed is:

1. A knife comprising:

a blade and a handle adapted to be grasped with a hand;

said blade comprising a body having a proximal and a distal end;

a longitudinally-extending tang disposed at the proximal end of said body, said tang serving to attach said handle to the body of said blade;

said blade having a first margin and a second margin, said first margin having a longitudinal sharp cutting edge disposed thereon and said second margin having a straight, flat edge disposed thereon, said second margin being on the opposite side of said body, said first and second margins merging together at their distal end to form a sharp tip;

a sharp cutting edge on each margin at said tip;

a serrated portion disposed on said first margin between said sharp cutting edge at said tip and said longitudinal sharp cutting edge;

said first margin being bowed outwardly from said body between said proximal end and said tip;

said second margin extending longitudinally from said proximal end for a predetermined length and then bending at an oblique angle for a second predetermined length to terminate in said tip, said oblique angle forming a first and a second segment on said second margin, said second segment forming a flat scraping portion of said knife.

2. The knife according to claim 1 wherein the oblique angle is between about 130 and 140 degrees.

3.The knife according to claim 1 wherein the length of the first margin is between about 2 to 3 times the length of the proximal end.

4. The knife according to claim 3 wherein said oblique angle is between about 130 and 140 degrees.

5. The knife according to claim 4 wherein said first segment has a length between about 25 and 30% of said second segment.

6. The knife according to claim 1 wherein the sharp tip constitutes between about 10 and 15% of said first and second margin.

7. A knife comprising:

a blade and a handle adapted to be grasped with a hand;

said blade comprising a body having a proximal and a distal end;

a longitudinally-extending tang disposed at the proximal end of said body, said tang serving to attach said handle to the body of said blade;

said blade having a sharp cutting edge on a first margin and a flat edge on a second margin, said second margin being on the opposite side of said body, said first and second margins merging together at their distal ends to form a tip, the length of the first margin being between about 2 to 3 times the length of the proximal end;

said tip having a sharp cutting edge on each margin, said tip constituting between about 10 and 15% of said second margin;

said first margin further having a serrated portion between the sharp cutting edge on said tip and the cutting edge between said proximal end and the sharp cutting edge on said tip, said serrated portion constituting between about 20 and 25% of the first margin;

said first margin being bowed outwardly between said proximal end and said distal end;

said second margin extending longitudinally from said proximal end for a predetermined length and then bending obliquely for a second predetermined length to terminate in said tip, the oblique angle being between about 130 and 140 degrees.

* * * * *